US007876051B2

(12) United States Patent
Andou et al.

(10) Patent No.: US 7,876,051 B2
(45) Date of Patent: Jan. 25, 2011

(54) ELECTRODE MOUNT, ARC TUBE, LOW-PRESSURE MERCURY VAPOR DISCHARGE LAMP, COMPACT SELF-BALLASTED FLUORESCENT LAMP AND METHOD OF MANUFACTURING THE ARC TUBE

(75) Inventors: Tamotsu Andou, Osaka (JP); Kenji Nakano, Kyoto (JP); Noriyuki Uchida, Osaka (JP); Yusuke Iwase, Osaka (JP)

(73) Assignee: Panasonic Corporation, Osaka (JP)

( * ) Notice: Subject to any disclaimer, the term of this patent is extended or adjusted under 35 U.S.C. 154(b) by 633 days.

(21) Appl. No.: 11/835,637

(22) Filed: Aug. 8, 2007

(65) Prior Publication Data

US 2008/0036396 A1 Feb. 14, 2008

(30) Foreign Application Priority Data

Aug. 11, 2006 (JP) ..... 2006-219971
Jul. 6, 2007 (JP) ..... 2007-178491

(51) Int. Cl.
*H01J 17/18* (2006.01)

(52) U.S. Cl. ..... 313/623

(58) Field of Classification Search ..... 313/631, 313/292, 27, 257, 262, 271
See application file for complete search history.

(56) References Cited

U.S. PATENT DOCUMENTS

2002/0000770 A1* 1/2002 Shibata et al. ..... 313/493
2004/0263079 A1* 12/2004 Nakanishi et al. ..... 313/631
2005/0104522 A1* 5/2005 Yabuki et al. ..... 313/634

FOREIGN PATENT DOCUMENTS

JP 1-163958 6/1989

* cited by examiner

*Primary Examiner*—Nimeshkumar D Patel
*Assistant Examiner*—Jacob Stern

(57) ABSTRACT

The electrode mount includes a filament coil, paired lead wires supporting the filament coil therebetween in a manner that the filament coil hangs across the lead wires; and bead glass retaining the paired leadwires. The arc tube includes an arc tube main body formed by winding a glass tube, and an electrode fixed to the end portion of the arc tube main body. For this electrode, the electrode mount is used. The fixing of the electrode mount at the end portion of the arc tube main body is made at a region of the lead wires positioned between the filament coil and the bead glass, and the bead glass is disposed outside the arc tube main body.

8 Claims, 4 Drawing Sheets

3

35
31
41
43
61
47
45
63

31
41
3a
43
47
45
61
63

49
33
41
3a
43
47
45
63

ELECTRODE MOUNT, ARC TUBE, LOW-PRESSURE MERCURY VAPOR DISCHARGE LAMP, COMPACT SELF-BALLASTED FLUORESCENT LAMP AND METHOD OF MANUFACTURING THE ARC TUBE

This application is based on applications No. 2006-219971 and No. 2007-178491 filed in Japan, the contents of which are hereby incorporated by reference.

BACKGROUND OF THE INVENTION (1) Field of Invention

The present invention relates to a structure of an electrode mount used for a low-pressure mercury vapor discharge lamp, an arc tube having an electrode using the mount, a low-pressure mercury vapor discharge lamp and a compact self-ballasted fluorescent lamp having the arc tube, and a method of manufacturing the arc tube.

(2) Related Art

Today in an age of energy conservation, low-pressure mercury vapor discharge lamps, especially compact self-ballasted fluorescent lamps, have been increasingly disseminated in the field of lighting technology as an energy saving light source that replaces incandescent lamps with low efficiency.

A compact self-ballasted fluorescent lamp includes an arc tube, a holder retaining the arc tube, an electronic ballast used for causing the arc tube to light and mounted on the holder, a case attached to the holder so as to house the electronic ballast therein, and a globe covering the arc tube and fixed to the case. Note that some compact self-ballasted fluorescent lamps include no globe (so-called "D" type).

The above-mentioned arc tube is formed by a glass tube, and includes electrodes fixed to both end portions of the glass tube. Each electrode includes a filament coil filled with an electron emissive material, a pair of lead wires supporting the filament coil therebetween in a manner that the filament coil hangs across the paired lead wires, and a glass member retaining the paired lead wire. Note that in this document, the word "electrode" is used to describe an electrode assembly being fixed to the end portion of the glass tube, and the electrode assembly having the same structure but having yet to be fixed to the end portion of the glass tube is referred to as a "mount".

The glass member is, for example, bead glass (an electrode with bead glass is a so-called "bead-glass type") as shown in FIG. 2 of Japanese Laid-Open Patent Application No. H01-163958, or a flare (an electrode with a flare is a so-called "flare type") as shown in FIG. 3 of Japanese Laid-Open Patent Application No. H01-163958.

Along with a reduction in a diameter of the glass tube in response to the recent demand for making the arc tube compact, bead-glass type electrodes are widely used because they have a simple structure and facilitate the downsizing of the arc tube.

The process of fixing a bead-glass type mount to the end portion of the glass tube includes inserting the filament coil into the glass tube in a manner to dispose the bead glass inside the glass tube, and then crushing flatly the end portion of the glass tube that corresponds to a part of the paired lead wires, extending on the opposite side from the filament coil in relation to the bead glass.

In such a bead-glass type mount, the filament coil is supported by thin lead wires in a manner that it hangs across the lead wires at their tips, and therefore the filament coil would tend to wobble without the bead glass. The bead glass is thus used to provide a firm structure, preventing the filament coil from wobbling, and herewith it is possible to efficiently fix the mount (electrode) to the end portion of the glass tube.

On the other hand, electrodes (mounts) having no such a glass member have also been proposed (see FIG. 1 of Japanese Laid-Open Patent Application No. H01-163958). With an electrode (mount) having no glass member, the part thereof inserted into the glass tube can be made short. That is, it is possible to shorten the distance between the filament coil and the end portion of the glass tube, thereby allowing a size reduction of the arc tube.

There has also been a demand for cost and size reduction of arc tubes. In terms of the above electrode (mount) having no glass member, however, although a size reduction of the arc tube can be realized, it is sometimes the case that the filament coil comes detached from the lead wires as a result of, for example, an increase in the gap between the paired lead wires. Thus, the problem still remains that the process of fixing the mount to the end portion of the glass tube cannot be efficiently performed due to the difficulties in the handling.

SUMMARY OF THE INVENTION

The present invention aims to provide new and useful electrode mount, arc tube, low-pressure mercury vapor discharge lamp, compact self-ballasted fluorescent lamp and method of manufacturing such a arc tube that solve the problems mentioned above.

In order to realize the above object, the electrode mount of the present invention is an electrode mount to be fixed to the end portion of the glass tube by pinch-sealing, and comprises: a filament coil made of a wire wound in a coil configuration; paired lead wires supporting the filament coil therebetween in a manner that the filament coil hangs across the lead wires; and a retainer retaining the lead wires. Here, the retainer is disposed on part of the lead wires, on the opposite side from the filament coil in relation to a region of the lead wires for application of the pinch-sealing.

According to the above structure, the mount includes the retainer, and it is therefore possible to prevent wobbling of the filament coil supported by the paired lead wires in a manner that it hangs across the lead wires. Herewith, when being fixed to the end portion of the glass tube, the mount can be efficiently fixed thereto because the filament coil in a stable condition (i.e. not wobbling) facilitates the insertion of the mount into the glass tube, whereby making the handling easier, as compared for example to a mount with no retainer.

Furthermore, if the mount is fixed to the end portion of the glass tube using a part of the paired lead wires positioned between the filament coil and the retainer, the distance between the end portion of the glass tube and the filament coil can be made short, and consequently the overall length of the glass tube can be shortened.

In addition, the distance between the central axis of a coil portion of the filament coil and the edge of the retainer, facing the filament coil, may be such that the retainer does not interfere with a thin tube to be attached to the end portion of the glass tube during the pinch-sealing.

Furthermore, the end portion of the glass tube may be curved, and part of the lead wires, to be disposed inside the glass tube, may be bent to follow the shape of the end portion of the glass tube. Here, the part of the lead wires is between the retainer and the filament coil. The retainer may be made of a glass material.

In order to realize the above object, the arc tube of the present invention comprises: a glass tube having a discharge space therein; and an electrode (i) including a filament coil, paired lead wires supporting the filament coil therebetween in a manner that the filament coil hangs across the lead wires, and a retainer retaining the lead wires, and (ii) fixed to the end portion of the glass tube at part of the lead wires by pinch-sealing. Here, the retainer is disposed outside the glass tube.

According to the above structure, the arc tube of the present invention includes the retainer retaining the paired lead wires and disposed outside the glass tube. Therefore, the distance between the filament coil and the end portion of the glass tube can be made short, consequently allowing the overall length of the glass tube to be shortened.

In addition, in order to realize the above object, the low-pressure mercury vapor discharge lamp of the present invention comprises: an arc tube including a glass tube and an electrode fixed to an end portion of the glass tube by pinch-sealing; and a base being a terminal for power supply to the arc tube. Here, the electrode includes a filament coil, paired lead wires supporting the filament coil therebetween in a manner that the filament coil hangs across the lead wires, and a retainer retaining the lead wires and disposed outside the glass tube.

According to the above structure, the low-pressure mercury vapor discharge lamp has an arc tube that includes the retainer retaining the paired lead wires and disposed outside the glass tube. Therefore, the distance between the filament coil and the end portion of the glass tube can be made short, consequently allowing the overall length of the glass tube to be shortened. As a result, the overall size of the lamp can be reduced.

Furthermore, in order to realize the above object, the compact self-ballasted fluorescent lamp of the present invention comprises: an arc tube including an electrode fixed to an end portion of a glass tube by pinch-sealing; an electronic ballast operable to cause the arc tube to light; and a case including a base, housing the electronic ballast therein, and retaining the arc tube. Here, the electrode includes a filament coil, paired lead wires supporting the filament coil therebetween in a manner that the filament coil hangs across the lead wires, and a retainer retaining the lead wires and disposed outside the glass tube.

According to the above structure, the compact self-ballasted fluorescent lamp has an arc tube that includes the retainer retaining the paired lead wires and disposed outside the glass tube. Therefore, the distance between the filament coil and the end portion of the glass tube can be made short, consequently allowing the overall length of the glass tube to be shortened. As a result, the overall size of the lamp can be reduced.

On the other hand, in order to realize the above object, the method of manufacturing the arc tube of the present invention includes a fixing process of fixing an electrode mount to the end portion of a glass tube by pinch-sealing. Here, the electrode mount includes a filament coil, paired lead wires supporting the filament coil therebetween in a manner that the filament coil hangs across the lead wires, and a retainer retaining the lead wires. The pinch-sealing is applied to part of the lead wires positioned between the filament coil and the retainer.

According to the manufacturing method, the paired lead wires are retained by the retainer, and therefore it is possible to prevent the filament coil from wobbling. Accordingly, when being fixed to the end portion of the glass tube, the electrode mount can be efficiently fixed because the filament coil in a stable condition (i.e. not wobbling) facilitates the insertion of the electrode mount into the glass tube, whereby making the handling easier, as compared for example to an electrode mount having no retainer.

Furthermore, if the mount is fixed to the end portion of the glass tube using a part of the paired lead wires positioned between the filament coil and the retainer, the distance between the end portion of the glass tube and the filament coil can be made short, and consequently the overall length of the glass tube can be shortened. As a result, the arc tube can be made compact in size.

In addition, the fixing process may be performed after a process of shaping the glass tube in a double spiral. Furthermore, a process of removing the retainer from the electrode mount may be performed after the fixing process.

BRIEF DESCRIPTION OF THE DRAWINGS

These and other objects, advantageous effects and features of the invention will become apparent from the following description thereof taken in conjunction with the accompanying drawings which illustrate specific embodiments of the invention. In the drawings.

DESCRIPTION OF PREFERRED EMBODIMENT

The following describes a preferred embodiment in which the present invention is applied to a compact self-ballasted fluorescent lamp—a type of low-pressure mercury vapor discharge lamps—with the aid of diagrams.

<Compact Self-Ballasted Fluorescent Lamp>

Figure 1:
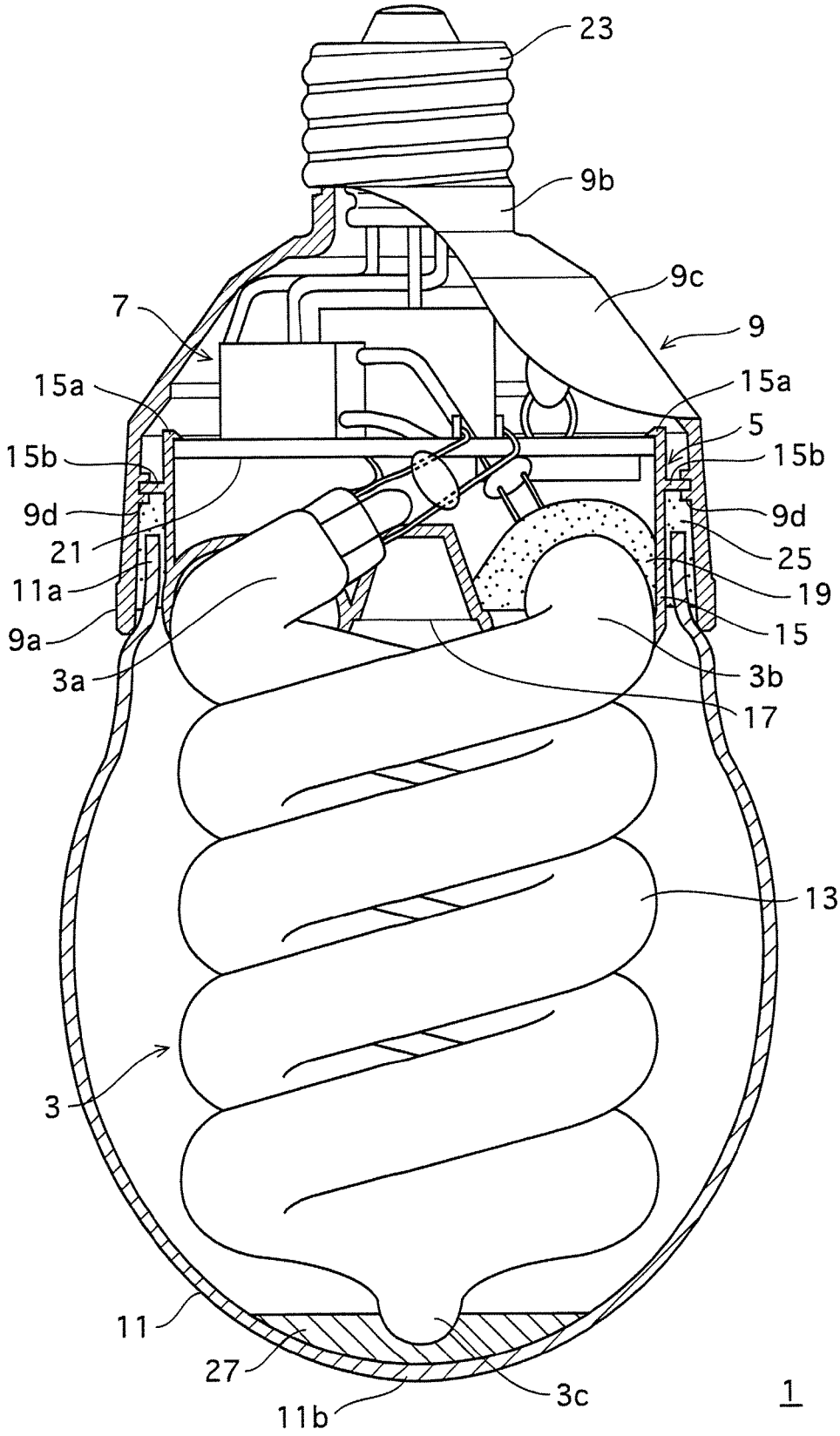
FIG. 1 is a schematic diagram of a compact self-ballasted fluorescent lamp of an embodiment.

FIG. 1 is a schematic diagram of the compact self-ballasted fluorescent lamp of the present embodiment. Note that the globe, case and the like are partially cut away in FIG. 1 to reveal the interior of the lamp.

A compact self-ballasted fluorescent lamp 1 includes, as shown in FIG. 1: an arc tube 3; a retainer 5 retaining the arc tube 3; an electronic ballast 7 mounted on the retainer 5, on the opposite side from where the arc tube 3 is disposed, and used for causing the arc tube 3 to emit light (i.e. to light); a case 9 attached to the retainer 5 so as to house the electronic ballast 7 therein; and a globe 11 whose opening is fixed to the retainer 5 or the case 9 so as to house the arc tube 3 therein.

Regarding the arc tube 3 to be further described later, an electrode is fixed to each of both end portions of a glass tube 13 wound in a double spiral, and a discharge space is formed inside the glass tube 13 when the end portions are closed by fixing the electrode thereto.

The retainer 5 has a cylindrical shape with one end closed, being made up of a peripheral wall 15 and an end wall 17 that blocks of f one end of the peripheral wall 15. On the end wall 17, receiving holes are formed for allowing end portions 3*a* and 3*b* of the arc tube 3 to be inserted therethrough to the inside of the retainer 5.

The retainment of the arc tube 3 is realized by inserting the end portions 3*a* and 3*b* of the arc tube 3 to the inside of the retainer 5 through the receiving holes, and then firmly fixing the end portions 3*a* and 3*b* of the arc tube 3 in such a state to the inner surface of the retainer 5 by an adhesive agent (for example, silicone) 19.

The electronic ballast 7 is of a series-inverter type composed of multiple electrical components, such as a capacitor and a choke coil, and a substrate 21 for mounting these electrical components is attached to the retainer 5 at the open end thereof.

The substrate 21 is attached to the retainer 5 by such a means that multiple locking arms 15*a* extending in the direction parallel to the central axis of the retainer 5 from the edge of the opening of the peripheral wall 15 engage with the periphery of the substrate 21. Note that multiple—for example, two—locking arms 15 are provided at even intervals in the circumferential direction of the peripheral wall 15.

The case 9 has a shape of a cone, for example, and includes a large diameter cylinder portion 9*a*, a small diameter cylinder portion 9*b* which has a smaller diameter than the large diameter cylinder portion 9*a*, and a funnel-shaped cylinder portion 9*c* connecting the large and small diameter cylinder portions 9*a* and 9*b*. On the small diameter cylinder portion 9*b* of the case 9, a screw base 23, such as E17, is attached.

The case 9 and the retainer 5 are attached to each other by such a means that engaging projection portions 15*b* formed on the outer surface of the peripheral wall 15 of the retainer 5 engage with locking depressions 9*d* formed on the inner peripheral surface of the case 9. Regarding the engaging projection portions 15*b* and locking depressions 9*d*, multiple pieces—for example, four—of each are provided on the case 9 or the retainer 5 at even intervals in the circumferential direction. It is sufficient if they are provided on either one of the case 9 and the retainer 5.

Note that the "case" of the present invention corresponds to the retainer 5 and the case 9 of the present embodiment, and may be a single-piece construction of the retainer and the case, or may be formed with separate pieces of the retainer 5 and the case 9.

The globe 11 here is, for example, of an A type. The globe 11 is firmly fixed to the case 9 and the retainer 5 by such a means that an end portion 11*a* positioned on the opening side of the globe 11 is inserted into the gap between the above-mentioned case 9 and retainer 5, and then an adhesive agent 25, such as silicone, is filled in the gap.

At a bottom 11*b* (lowermost part in FIG. 1) of the globe 11, a thermal connection member 27 which thermally connects with an apical portion 3*c* of the arc tube 3 (the apical portion becomes the coldest spot during the period when the arc tube 3 is lit) is provided. The thermal connection member 27 is designed to transmit heat of the arc tube 3 to the globe 11 during the period when the arc tube 3 is lit, to thereby reduce the temperature of the arc tube 3.

Note that on the internal surface of the globe 11, a calcium carbonate-based diffuser film is applied.

<Arc Tube>

Figure 2:
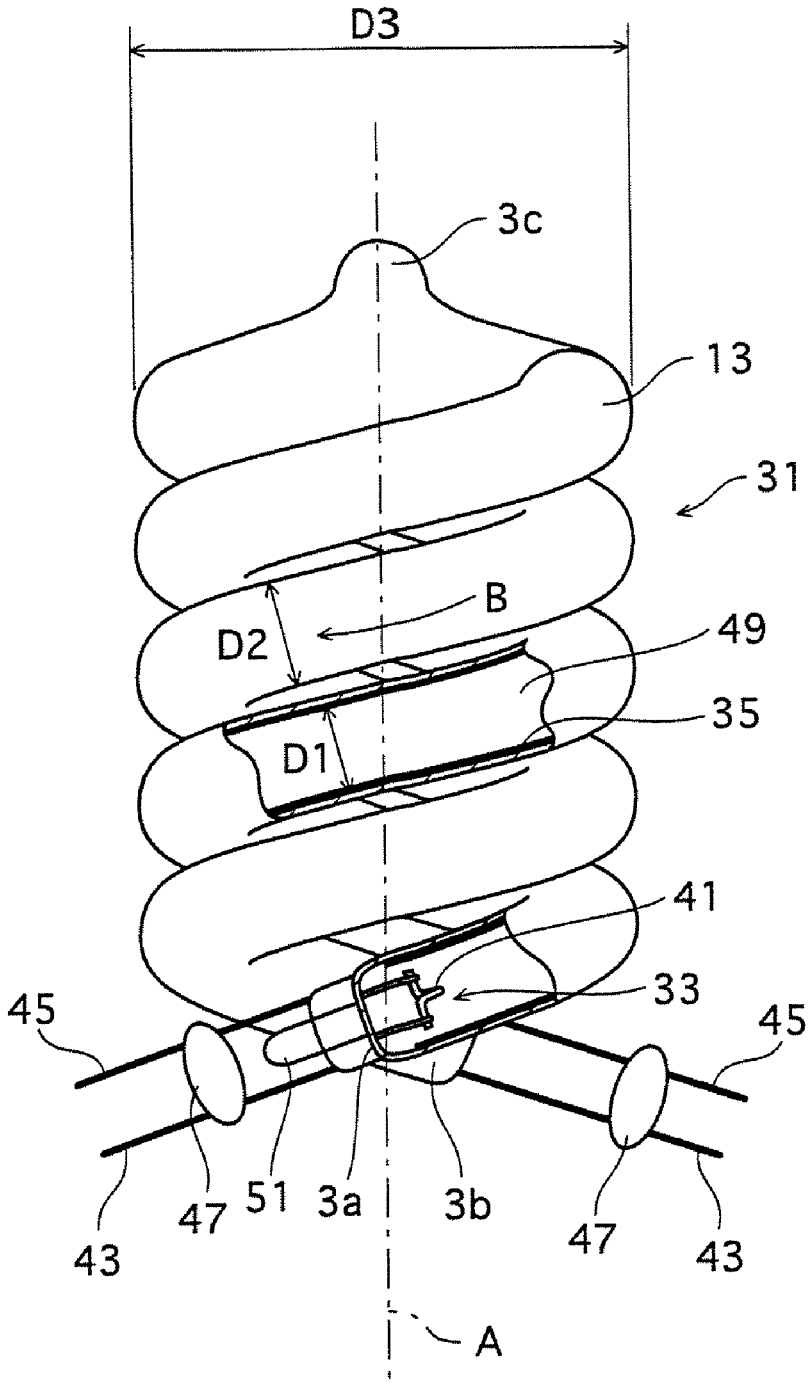
FIG. 2 is a schematic diagram of an arc tube of the embodiment.

FIG. 2 is a schematic diagram of the arc tube of the present embodiment. In the figure, the glass tube 13 is partially cut away to reveal the interior of the arc tube 3.

The arc tube 3 includes an arc tube main body 31 formed by the wound glass tube 13 and electrodes 33 fixed to the end portions 3*a* and 3*b* of the arc tube main body 31. In this description, the electrode 33 is described to be fixed to each of the end portions 3*a* and 3*b* of the arc tube main body 31; however, this represents the same configuration as that in which the electrode 33 is fixed to each end portion of the glass tube 13 of the arc tube main body 31.

Although FIG. 2 shows only one electrode 33 disposed at the end portion 3*a* of the arc tube 3, another electrode having the same structure is also fixed to the other end portion 3*b* of the arc tube 3. The end portions of the arc tube main body 31 and the end portions of the glass tube 13 are also the end portions 3*a* and 3*b* of the arc tube 3, and the reference letters "3*a*, 3*b*" are used to refer to all of these end portions.

The arc tube main body 31 has a double spiral structure in which the glass tube 13 doubly spiral in a direction B around a pivotal axis A. Note that the number of winding turns around the pivotal axis A is decided based on the lamp specification (rated lamp wattage and the like). Parts of the glass tube 13 close to the end portions 3*a* and 3*b* of the arc tube main body 31 are wound in a manner to have a larger gap therebetween with immediately adjacent parts of the glass tube 13 in the direction of the pivotal axis A.

On the inner surface of the arc tube main body 31 (glass tube 13), a phosphor layer 35 is formed. The phosphor layer 35 includes one or more kinds of phosphors, such as rare earth phosphors. In the arc tube main body 31, mercury functioning as a light-emitting material, a rare gas functioning as a buffer gas and the like are enclosed.

<Electrode>

Figure 3A:
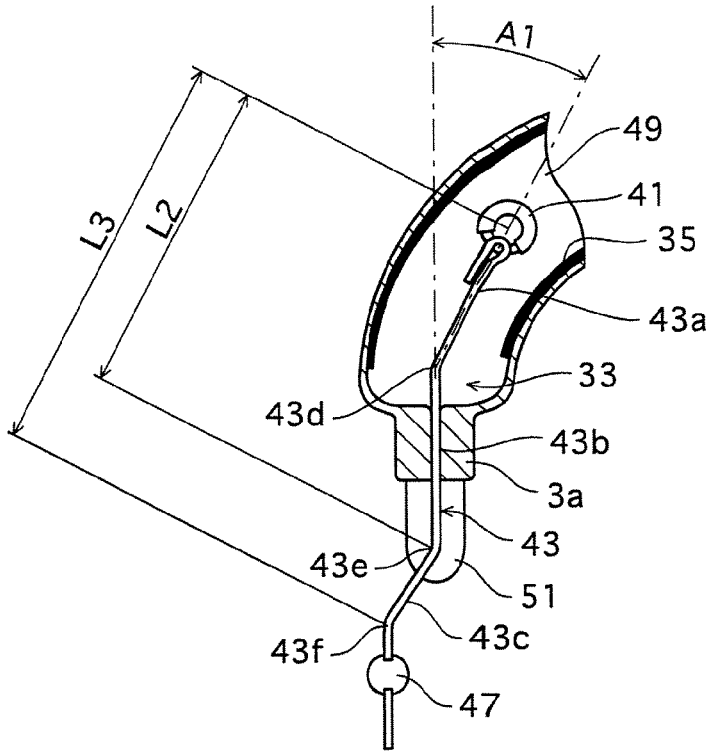
FIG. 3A shows an electrode fixed to an end portion of an arc tube main body, viewed from the direction in which a central axis of a filament coil lies.
Figure 3B:
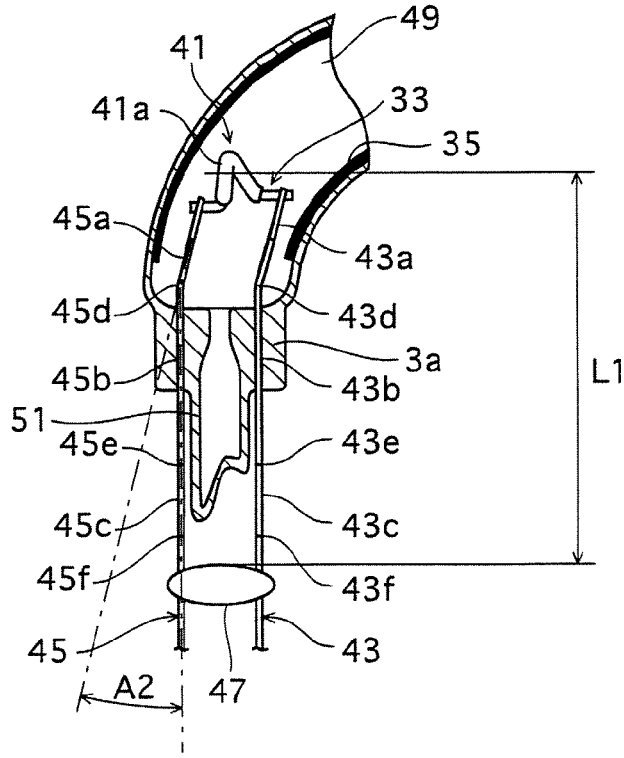
FIG. 3B shows the electrode fixed to the end portion of the arc tube main body, viewed from the direction perpendicular to the central axis of the filament coil.

FIG. 3A shows an electrode fixed to the end portion of the arc tube, viewed from the direction in which the central axis of the filament coil lies. FIG. 3B shows the electrode fixed to the end portion of the arc tube, viewed from the direction perpendicular to the central axis of the filament coil.

The electrode 33 includes the filament coil 41 and the paired lead wires 43 and 45 supporting the filament coil 41 therebetween in a manner that the filament coil 41 hangs across the lead wires 43 and 45 at their tips on one side (i.e. the lead wires 43 and 45 retain the filament coil 41 so as to bridge them), as shown in FIGS. 2, 3A and 3B. The paired lead wires 43 and 45 are retained by bead glass 47 (corresponding to the "retainer" of the present invention) made of a glass material and straddling them (bead-glass type).

The bead glass 47 above is provided, on the paired lead wires 43 and 45, on the opposite side from the filament coil 41 in relation to a region of the lead wires to which pinch-sealing is applied. That is, the paired lead wires 43 and 45 are pinch-sealed at the end portion 3*a*/3*b* of the arc tube main body 31 with the filament coil 41 disposed therein, as described later. Then, the bead glass 47 is provided on the lead wired 43 and 45 in a manner to straddle them on the opposite side from the filament coil 41 in relation to the region for the pinch-sealing application (corresponding to the "region of the lead wires for application of the pinch-sealing" of the present invention).

The filament coil 41 is formed by multiple-coiling, for example, a tungsten wire (a coil state) (the part wound in a coil configuration is referred to as a "coil portion" and indicated by a reference letter "41*a*"). With the filament coil 41, the number of winding turns of the last coiling stage is substantially one. Note that the filament coil 41 is filled with an electron emissive material.

Each of the tips of the paired lead wires 43 and 45 extending from the bead glass 47 toward the filament coil 41 is folded back in a manner to hold therebetween the end portion of the filament coil 41, as shown in FIG. 3A. Herewith, the filament coil 41 is provided to hang across the lead wires 43 and 45 at their tips on one side.

As shown in FIG. 3B, the paired lead wires 43 and 45 are arranged in substantially parallel to each other. Each of the paired lead wires 43 and 45 is largely divided into three portions, as shown in FIGS. 3A and 3B: a discharge space portion 43*a*/45*a* disposed in a discharge space 49, to be described later, formed inside the arc tube 3; a sealed-in portion 43*b*/45*b* sealed at the end portion 3*a* of the arc tube main body 31; and an external portion 43*c*/45*c* disposed outside the arc tube main body 31.

In the discharge space portion 43*a*/45*a* of the lead wire 43/45, one or more bends—here, a single bend 43*d*/45*d*—are formed so that the lead wire 43/45 follows the shape of the end portion 3*a* of the arc tube main body 31. Note that, when the lead wires 43 and 45 are yet to be inserted into the arc tube main body 31, the discharge space portions 43*a* and 45*a* of the above lead wires 43 and 45 are yet portions of the lead wires 43 and 45 planned to be disposed inside the glass tube 13.

The reason that the bend 43*d*/45*d* is provided in the discharge space portion 43*a*/45*a* is to prevent the filament coil 41 from coming in contact with the inner surface of the arc tube main body 31 when the filament coil 41 is inserted into the end portion 3*a* of the arc tube main body 31.

Also, in the external portion 43*c*/45*c* of the lead wire 43/45 of the electrode 33 fixed to the end portion 3*a* of the arc tube main body 31 together with a thin tube 51, one or more bends—here, two bends 43*e*/45*e* and 43*f*/45*f*—are formed in a manner that the bead glass 47 is disposed outside the thin tube 51 so as not to interfere with the thin tube 51, as shown in FIG. 3A.

The electrode 33 is fixed to the arc tube main body 31 by such a means that the end portion 3*a* of the arc tube main body 31 is pinch-sealed at a part of the paired lead wires 43 and 45, between the bead glass 47 and the filament coil 41.

The discharge space 49 is formed inside the arc tube main body 31 when the end portion 3*a* of the arc tube main body 31 is sealed (precisely speaking, when the thin tube 51, to be described hereinafter, is sealed).

At the end portion 3*a* of the arc tube main body 31, the thin tube 51 is sealed together with the electrode 33. The thin tube 51 is used to form a vacuum inside the arc tube main body 31 and feed in mercury, a buffer gas and the like therefrom to the inside of the arc tube main body 31 after the electrode 33 is fixed. After gas is exhausted from the arc tube main body 31 and then mercury and a buffer gas are fed in, the thin tube 51 is sealed using, for example, a tip-off method.

<Method of Manufacturing Arc Tube>

The following describes the method of manufacturing the arc tube 3, especially the fixing process for the arc tube main body 31. Here, the mount (the "electrode mount" of the present invention) also refers to an electrode assembly yet to be fixed to the arc tube main body, and includes the filament coil 41, the paired lead wires 43 and 45, and the bead glass 47 (retainer).

Figures 4A, 4B, 4C:
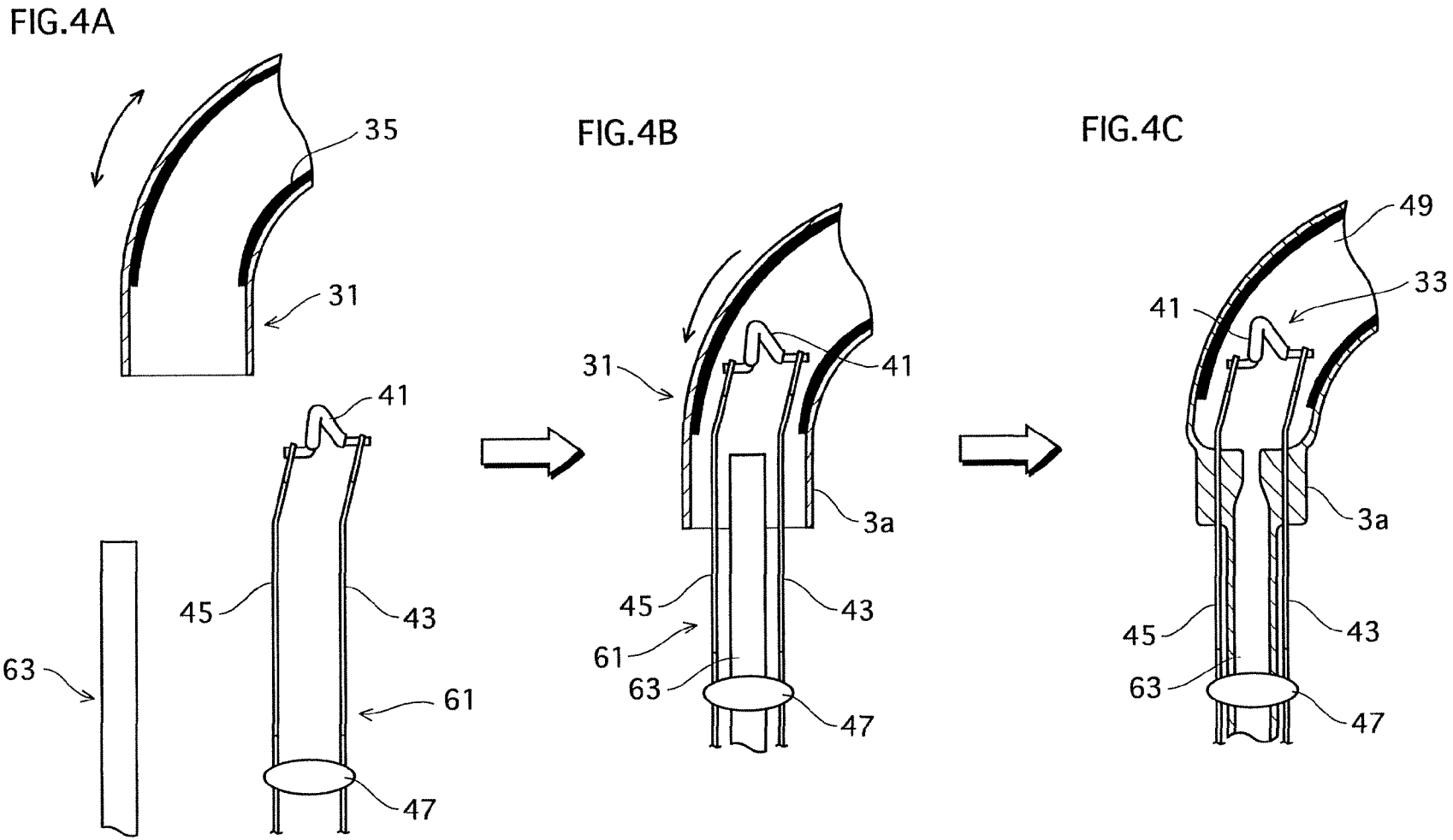
FIGS. 4A to 4C are explanatory drawings showing a fixing process of a mount.

FIGS. 4A to 4C are explanatory drawings showing the fixing process of the mount.

First, the above-mentioned arc tube main body 31 formed in a double spiral structure, an electrode mount 61, and a thin tube 63 are prepared as shown in FIG. 4A. Note that a phosphor has been coated on the inner surface of the arc tube main body 31.

Although having basically the same structure as a publicly known bead-glass type electrode, the mount 61 differs from it in that the bead glass 47 is attached, on the lead wires 43 and 45, at a position farther away from the filament coil 41 as compared to the conventional one.

The fixing process for the arc tube main body 31 here is described with reference to the mount 61 fixed to the one end portion 13*a* of the arc tube main body 31 together with the thin tube 63; however, fixing of the mount at the other end portion 13*b* of the arc tube main body 31 is also performed in a similar fashion.

Next, the arc tube main body 31 is retained rotatably around the pivotal axis. Then, the mount 61 is retained in such a manner that, when the arc tube main body 31 rotates, the filament coil 41 goes into the arc tube main body 31 (glass tube 13) from the end thereof.

At this point, the paired lead wires 43 and 45, which support the filament coil 41 therebetween in a manner that it hangs across the lead wires 43 and 45, are retained by the bead glass 47 positioned a predetermined distance away from the filament coil 41. Therefore, it is possible to prevent the filament coil 41 from wobbling, or from breaking off as a result of an increase in the gap between the tips of the paired lead wires 43 and 45. This realizes efficient handling of the mount 61 when it is inserted into the arc tube main body 31.

Subseqently, the arc tube main body 31 is rotated in a direction that the arc tube main body 31 comes closer to the mount 61, as shown in FIG. 4B. With this movement, the filament coil 41 enters into the arc tube main body 31 from the end portion 3*a* thereof. After the tip of the thin tube 63 and the filament coil 41 are inserted into the arc tube main body 31, and respectively move over predetermined distances measured from the end face of the arc tube main body 31, the rotation of the arc tube main body 31 is stopped. FIG. 4B shows the condition at this time point.

At this point, the bead glass 47 of the mount 61 is located outside the arc tube main body 31, and therefore the distance between the filament coil 41 and the end face of the arc tube main body 31 can be set short. Accordingly, even when the fixing process of the mount 61 is performed at the end portion 3*a* of the double-spiral arc tube main body 31 having a small curvature radius, it is possible to prevent the filament coil 41 from coming in contact with the inner surface of the arc tube main body 31.

Furthermore, as compared to the case of using a conventional mount in which the bead glass (47) is disposed inside the arc tube main body (31), the insertion length of the mount 61 into the arc tube main body 31 can be set shorter, and accordingly the insertion of the filament coil 41 into the arc tube main body 31 is readily realized.

Note that, if the filament coil 41 comes in contact with, for example, the inner surface of the arc tube main body 31, the temperature of the electrode 33 (filament coil 41) is lowered during the period when the lamp is lit, whereby shortening the operating life and the like.

Next, the end portion 3*a* of the arc tube main body 31 is heated by, for example, a gas burner and then crushed using a pinch block. Herewith, the sealed-in portion 43*b*/45*b* of the lead wire 43/45 of the mount 61 and the thin tube 63 are welded to the end portion 3*a* of the arc tube main body 31. FIG. 4C shows the condition at this time point.

Note that the fixing process of the mount (61) at the other end portion 3*b* of the arc tube main body 31 can be realized in the same manner as for the above mount 61. After mercury, a rare gas and the like are filled in the arc tube main body 31 through the thin tube 63, the end portion of the thin tube 63 is tipped off and sealed, thereby the arc tube 3 is completed.

Thus, the mount 61 of the present invention allows for a short insertion distance of the filament coil 41 into the arc tube main body 31. This means that the insertion length of the lead wires 43 and 45 into the arc tube main body 31 can be made short. As a result, the overall length of the glass tube 13 can be made short, enabling the arc tube 3 to be compact in size.

<Method of Manufacturing Lamp>

The lamp 1 is manufactured with the following processes: an arc tube attachment process of attaching the arc tube 3 manufactured in the above-mentioned method to the retainer 5; an ballast fitting process of fitting the substrate 21, on which electrical components making up the electronic ballast 7 are mounted, to the retainer 5; a case attachment process of attaching the case 9 to the retainer 5, to which the electronic ballast 7 has been fitted, so as to provide an outside covering; and a globe fitting process of fitting the globe 11 to the case 9 and the retainer 5.

With the arc tube 3 having the above structure, the paired lead wires 43 and 45 extending outwardly from the end portions 3*a* and 3*b* of the arc tube 3 are retained by the bead glass 47. As a result, the lead wires 43 and 45 are less likely to get tangled with each other when the arc tube 3 is attached to the retainer 5, thus facilitating the attachment of the arc tube 3 to the retainer 5.

Especially with the recent lamp 1, the overall size of the lamp has been reduced, resulting in that the electrical components making up the electronic ballast 7 housed in the case 9 are closely spaced from one another. As a result, a short circuit is more likely to occur due to the lead wires 43 and 45 extending from the end portions 3*a* and 3*b* of the arc tube 3 coming in contact with each other, or with another electrical component, which consequently leads to a reduction in quality of the lamp. However, the paired lead wires 43 and 45 are retained, by the bead glass 47, in a manner that they have a predetermined space therebetween (i.e. being parallel to each other), whereby preventing the lead wires 43 and 45 from coming in contact with each other. As a result, the quality and reliability of the lamp can be improved.

PRACTICAL EXAMPLE

The following explains a practical example of the arc tube of the above embodiment.

(1) Electrode Mount

First, the mount 61 is explained. A tungsten wire with a wire diameter of 0.036 mm is used for the filament coil 41, and iron-nickel-chrome alloy with a wire diameter of 0.35 mm is used for the paired lead wires 43 and 45.

The coil portion 41*a* (see FIG. 3B) of the filament coil 41 is filled with an electron emissive material, which is first applied thereto in the form of a composite carbonate of alkaline earth metals Ba—Sr—Ca including zirconium or zirconium oxide and is subsequently altered to a composite oxide by means of a so-called decomposition process.

The bead glass 47 has a shape of an oval sphere, as shown in FIGS. 3A and 3B, with a major diameter of 4.2 mm and a minor diameter of 3.0 mm. The bead glass 47 is positioned and attached to the paired lead wires 43 and 45, approximately 21 mm ("L1" in FIG. 3B) from the central axis of the filament coil 41 in a manner to straddle the lead wires 43 and 45.

The gap between the paired lead wires 43 and 45 is 3.5 mm at a point where the filament coil 41 is disposed and 3.0 mm at a point where the bead glass 47 is disposed.

In addition, to facilitate the insertion into the double-spiral arc tube main body 31, the bend 43*d*/45*d* is provided within the part of the lead wire 43/45, located inside the arc tube main body 31 (i.e. the discharge space portion 43*a*/45*a* of the lead wire 43/45), in accordance with the curvature (shape) of the spiral arc tube main body 31.

The bends 43*d* and 45*d* are provided approximately 4.7 mm away from the central axis of the filament coil 41 toward the bead glass 47. At the bend 43*d*/45*d*, the lead wire 43/45 is bent twice in different directions (two different bending directions of the lead wire 43/45, shown in FIGS. 3A and 3B, respectively).

One bending direction makes an angle of 29°, as indicated by "A1" of FIG. 3A, when the electrode 33 is viewed from the direction in which the central axis of the filament coil 41 lies; the other bending direction makes an angle of 17°, as indicated by "A2" of FIG. 3B, when the electrode 33 is viewed from the direction perpendicular to the central axis of the filament coil 41.

Within each of the lead wires 43 and 45, the sealed-in portion 43*b*/45*b* sealed at the end portion 3*a* of the arc tube main body 31 together with the thin tube 51 and the external portion 43*c*/45*c* disposed outside of the arc tube main body 31 have two bends 43*e*/45*e* and 43*f*/45*f* so that the bead glass 47 and the thin tube 51 do not interfere each other.

The bends 43*e* and 45*e* are positioned 14 mm away from the filament coil 41 ("L2" of FIG. 3A), and are provided so as to dispose the bead glass 47 outside (the central axis of) the thin tube 51. The bends 43*f* and 45*f* are positioned 19 mm away from the filament coil 41 ("L3" of FIG. 3A), and are provided so that the remaining part of the lead wires 43 and 45 (within which the bead glass 47 is disposed) become parallel to the thin tube 51. The bead glass 47 is attached within 10 mm from the bends 43*f* and 45*f*.

(2) Arc Tube Main Body

The glass tube 13 of the arc tube main body 31 is made of a lead-free glass material. As shown in FIG. 2, the glass tube 13 has an inner diameter D1 of 5.5 mm and an outer diameter D2 of 7.5 mm. The central axis of the glass tube 13 spirals around the pivotal axis A with a spiral radius of approximately 12.8 mm, and the pitch of the spiral in the direction of the pivotal axis is 18 mm. Herewith, the double-spiral arc tube main body 31 with an outer circumference D3 of approximately 33 mm can be obtained.

For the phosphor layer 35 formed on the inner surface of the glass tube 13 of the arc tube main body 31, three kinds of rare-earth phosphors of, for example, red ($Y_2O_3$:Eu), green ($LaPO_4$:Ce,Tb) and blue ($BaMg_2Al_{16}O_{27}$:Eu,Mn) are used.

1 mg mercury is enclosed in the arc tube main body 31, and rare gases used are mixed gas of argon and krypton sealed at 550 Pa.

In the arc tube 3 completed with the mount 61 being fixed to the end portion 3*a*/3*b* of the arc tube main body 31, the part of each lead wire 43/45 disposed in the discharge space 49 has a length of 5 mm, and the bead glass 47 is disposed approximately 10 mm away from the end portion 3*a*/3*b* of the arc tube main body 31.

Note that, in the conventional arc tube having bead glass therein, the part of each lead wire disposed in the discharge space is 10 mm in length. Therefore, according to the present invention, the glass tube of the arc tube can be reduced by 5 mm for each electrode (in total, 10 mm), as compare to the conventional arc tube.

The distance between the central axes of two filament coils in the discharge space—i.e. a so-called electrode distance—is 400 mm.

It has been determined that a lamp with the above-mentioned arc tube achieves, with an input power of 12 W, an initial luminous flux of 810 lm, which is the same as that of a common 60 W incandescent lamp.

As to the lamp 1 in which the electrode 33 has a typical structure according to the present embodiment, the overall length of the part of each lead wire 43/45 of the electrode 33 airtightly sealed in the arc tube 3 (i.e. discharge space portion 43*a*/45*a*) is approximately 5 mm. This enables an approximately 506 reduction from the conventional electrode, about 10 mm.

Accordingly, the arc tube 3 can be made compact in size with 33 mm in outer circumference, as compared to the conventional arc tube, 36 mm. In addition, since the inner diameter D1 of the glass tube 13 can be made comparatively small—for example, 7 mm or less, the present invention is applicable to a small-size double spiral arc tube 3.

Furthermore, at the end of the operating life of the lamp, the operation of the lamp 1 can be stopped by that heat released from the filament coil 41 is transmitted, via the lead wires 43 and 45, to a sealing portion by which the electrode 33 is fixed or a part of the glass tube 13 adjacent to the sealing portion. Then, the sealing portion or the adjacent part is melted by the heat, thereby allowing external air to flow into the arc tube 3.

<Modifications>

The present invention has been described based on the above preferred embodiment; however, it is a matter of course that the present invention is not limited to the specific examples described in the above embodiment. The following modifications are also within the scope of the present invention.

1. Lamp and Arc Tube

The electrode, or mount, according to the present invention is also applicable to compact fluorescent lamps that have recently been widely in use as an energy saving light source together with compact self-ballasted fluorescent lamps. Note that compact fluorescent lamps include an arc tube, a case retaining the arc tube (corresponding to the retainer and the case of the embodiment, which may be a single-piece construction of the retainer and the case, or may be formed from separate pieces), a single base (e.g. G10 type) attached to the case and supplying power to the arc tube.

Furthermore, the electrode, or mount, of the present invention is basically applicable to various common lighting fluorescent lamps—for example, straight tube fluorescent lamps and circular tube fluorescent lamps, and small-size fluorescent lamps for liquid crystal back-lighting devices.

That is to say, the present invention is applicable to low-pressure mercury vapor discharge lamps including the above-mentioned various types of lamps.

The above preferred embodiment and modifications show the examples in which the present invention is applied to a spiral arc tube main body. However, it can be also applied to such an arc tube that the end portions of the glass tube, to which the electrode mount is fixed, are curved and therefore the insertion of the filament coil into the arc tube main body is difficult.

It is a matter of course that the mount of the present invention can be applied to a straight arc tube whose glass tube has uncurved end portions.

2. Bead Glass (Retainer)

In the preferred embodiment above, the bead glass (47) disposed outside the arc tube main body 31 is left after the assembly of the lamp. However, the bead glass can be removed at any time after the fixing process—i.e. after the arc tube is fitted to the retainer, or after the lead wires of the arc tube and the substrate are electrically connected to each other, let alone immediately after the fixing process.

Note that the electrode, from which the bead glass has been removed after the fixing process, is composed of the filament coil and the paired lead wires.

To remove the bead glass, the bead glass may be melted by heat application, split up, or crushed. In such a case, the part of the lead wires to which the bead glass was attached has a different color as compared to the rest of the lead wires.

In the preferred embodiment, the bead glass has a shape of an oval sphere; however, it may have a different shape, such as a sphere, a multi-sided prism, or a multi-sided pyramid.

3. Retainer

In the preferred embodiment above, the bead glass made of a glass material is used as the retainer; however, a different material can be used instead.

For example, a ceramic material and a resin material can be used instead. In view of the current supply to the filament coil via the lead wires, however, the material of the retainer is preferably an insulating material. Note however that the retainer may be made of a conductive material if insulation is provided by, for example, forming an insulating film on the lead wires. Also, in view of the temperature of the filament coil during the lighting, the retainer is desirably made of a high heat-resistant material.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. An electrode mount to be fixed to an end portion of an arc glass tube by a pinch-sealing of the arc glass tube, comprising:

a filament coil made of a wire wound in a coil configuration;

paired lead wires supporting the filament coil therebetween in a manner that the filament coil hangs across the lead wires; and a retainer retaining the lead wires, wherein the retainer is a glass bead disposed on part of the lead wires external to the arc glass tube and on an opposite side from the filament coil in relation to a region of the lead wires for application of the pinch-sealing, the region of the lead wires for the pinch-sealing being between the retainer and the filament coil.

2. The electrode mount of claim 1, wherein a distance between a central axis of a coil portion of the filament coil and an edge of the retainer, facing the filament coil, is such that the retainer does not interfere with a thin tube to be attached to the end portion of the arc glass tube during the pinch-sealing.

3. The electrode mount of claim 1, wherein the end portion of the arc glass tube is curved, and part of the lead wires, to be disposed inside the glass tube, is bent to follow a shape of the end portion of the arc glass tube, the part of the lead wires being between the retainer and the filament coil.

4. The electrode mount of claim 2, wherein the end portion of the arc glass tube is curved, and part of the lead wires, to be disposed inside the arc glass tube, is bent to follow a shape of the end portion of the arc glass tube, the part of the lead wires being between the retainer and the filament coil.

5. The electrode mount of claim 4, wherein the retainer is made of a glass material.

6. An arc tube comprising:

a glass tube having a discharge space therein; and an electrode (i) including a filament coil, paired lead wires supporting the filament coil therebetween in a manner that the filament coil hangs across the lead wires, and a glass bead retaining the lead wires, and (ii) fixed to an end portion of the glass tube at part of the lead wires by pinch-sealing, wherein the glass bead is disposed outside the glass tube and the filament coil is within the glass tube.

7. A low-pressure mercury vapor discharge lamp comprising:

an arc tube including a glass tube and an electrode fixed to an end portion of the glass tube by pinch-sealing; and a base being a terminal for power supply to the arc tube, wherein the electrode includes a filament coil, paired lead wires supporting the filament coil therebetween in a manner that the filament coil hangs across the lead wires, and a glass bead retaining the lead wires is disposed outside the glass tube and the filament coil is within the glass tube.

8. A compact self-ballasted fluorescent lamp comprising:

an arc tube including an electrode fixed to an end portion of a glass tube by pinch-sealing;

an electronic ballast operable to cause the arc tube to light; and a case including a base, housing the electronic ballast therein, and retaining the arc tube, wherein the electrode includes a filament coil, paired lead wires supporting the filament coil therebetween in a manner that the filament coil hangs across the lead wires, and a glass bead retaining the lead wires is disposed outside the glass tube with the filament coil within the glass tube.

* * * * *